US008668510B2

(12) United States Patent
Roussie

(10) Patent No.: US 8,668,510 B2
(45) Date of Patent: Mar. 11, 2014

(54) TUBULAR COMPONENT HAVING AN ELECTRICALLY INSULATED LINK PORTION WITH A DIELECTRIC DEFINING AN ANNULAR SEALING SURFACE

(75) Inventor: Gabriel Roussie, Valenciennes (FR)

(73) Assignee: Vam Drilling France, Cosne Cours sur Loire (FR)

( * ) Notice: Subject to any disclaimer, the term of this patent is extended or adjusted under 35 U.S.C. 154(b) by 0 days.

(21) Appl. No.: 13/297,646

(22) Filed: Nov. 16, 2011

(65) Prior Publication Data

US 2012/0122330 A1 May 17, 2012

(30) Foreign Application Priority Data

Nov. 16, 2010 (FR) ..... 10 04446

(51) Int. Cl.
*H01R 13/52* (2006.01)
*H01R 9/05* (2006.01)

(52) U.S. Cl.
USPC ..... 439/271; 439/578

(58) Field of Classification Search
USPC ..... 439/271–275, 578–585, 190, 194
See application file for complete search history.

(56) References Cited

U.S. PATENT DOCUMENTS

| | | | | |
|---|---|---|---|---|
| 3,170,137 | A | 2/1965 | Brandt et al. | |
| 3,518,608 | A | 6/1970 | Papadopoulos et al. | |
| 3,696,332 | A | 10/1972 | Dickson et al. | |
| 3,879,097 | A * | 4/1975 | Oertle | 340/855.1 |
| 4,095,865 | A | 6/1978 | Denison et al. | |
| 4,445,735 | A | 5/1984 | Bonnefoy | |
| 6,670,880 | B1 | 12/2003 | Hall et al. | |
| 6,688,396 | B2 * | 2/2004 | Floerke et al. | 166/380 |
| 6,717,501 | B2 | 4/2004 | Hall et al. | |
| 7,114,970 | B2 | 10/2006 | Head | |
| 7,156,676 | B2 * | 1/2007 | Reynolds, Jr. | 439/194 |
| 7,226,090 | B2 | 6/2007 | Hughes | |
| 2004/0082218 | A1 * | 4/2004 | Stirling | 439/587 |
| 2004/0242044 | A1 * | 12/2004 | Head | 439/190 |
| 2005/0092499 | A1 | 5/2005 | Hall et al. | |
| 2005/0115717 | A1 | 6/2005 | Hall et al. | |
| 2006/0225926 | A1 | 10/2006 | Madhavan et al. | |
| 2006/0246774 | A1 * | 11/2006 | Buck | 439/578 |

FOREIGN PATENT DOCUMENTS

FR 2 883 915 10/2006

OTHER PUBLICATIONS

Office Action issued Jun. 29, 2011 in French Patent Application No. 10 04446, filed Nov. 16, 2010.
U.S. Appl. No. 13/821,462, filed Mar. 7, 2013, Chabas, et al.
U.S. Appl. No. 13/822,136, filed Mar. 11, 2013, Chabas, et al.

* cited by examiner

*Primary Examiner* — Chandrika Prasad
(74) *Attorney, Agent, or Firm* — Oblon, Spivak, McClelland, Maier & Neustadt, L.L.P.

(57) ABSTRACT

A tubular component of a drill stem comprises a first end including a first threading, a second end including a second threading, and a substantially tubular central zone, the component further comprising a device for electrical connection with another component, mounted on at least one of the ends, and a cable for the transmission of signals between the first end and the second end, connected to the connecting device, the connecting device including at least one conductor provided with an electrically insulated link portion and an electrical contact portion; a dielectric to isolate the insulated link portion; and an annular sealing surface defining a protected zone, said electrical contact portion being disposed in the protected zone, the annular sealing surface being disposed at the surface of the insulated link portion.

22 Claims, 7 Drawing Sheets

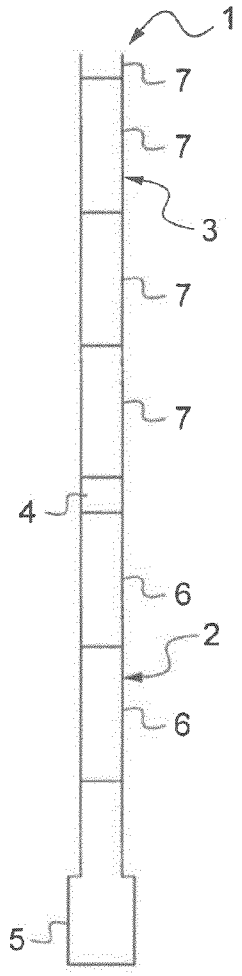
Fig. 1
Fig. 2
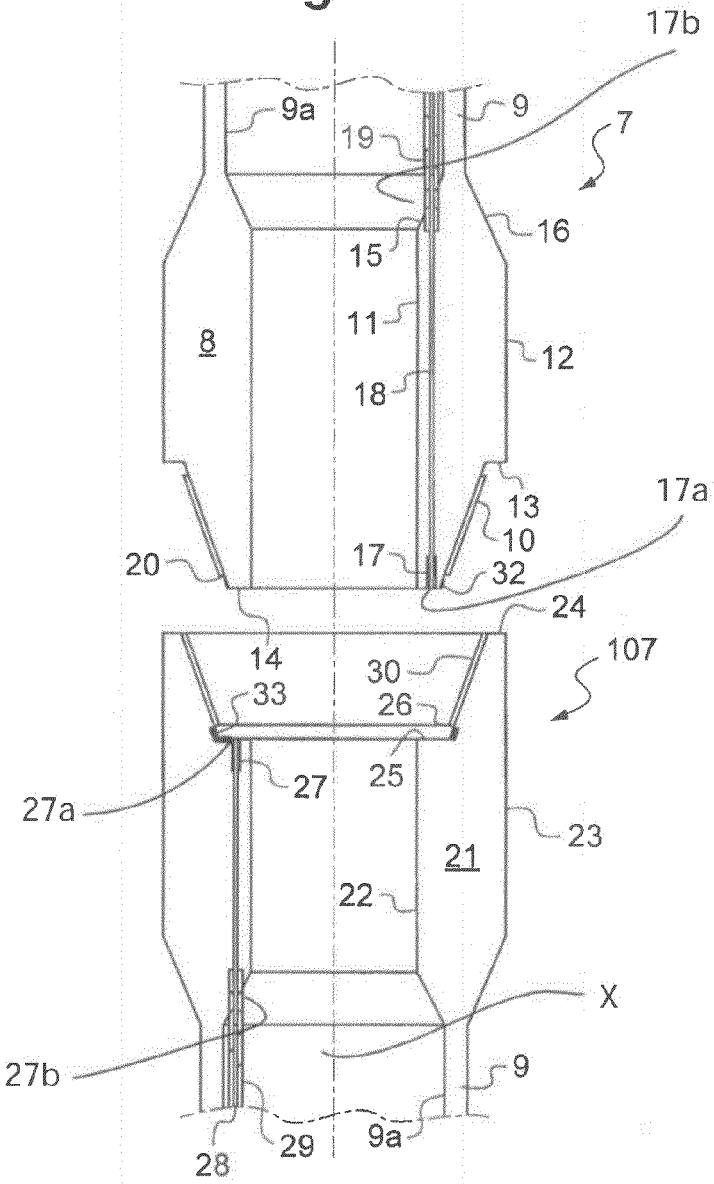

Fig. 5
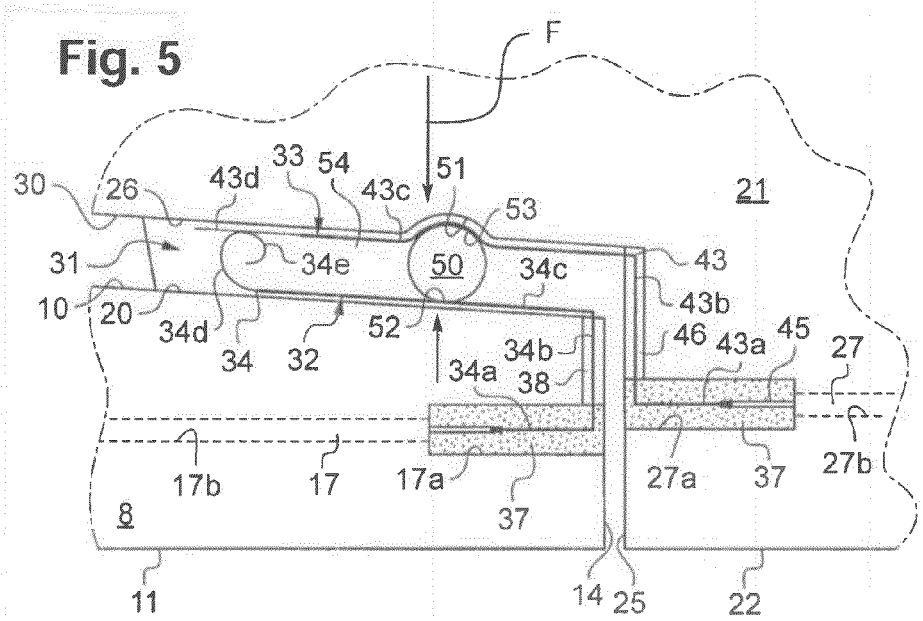
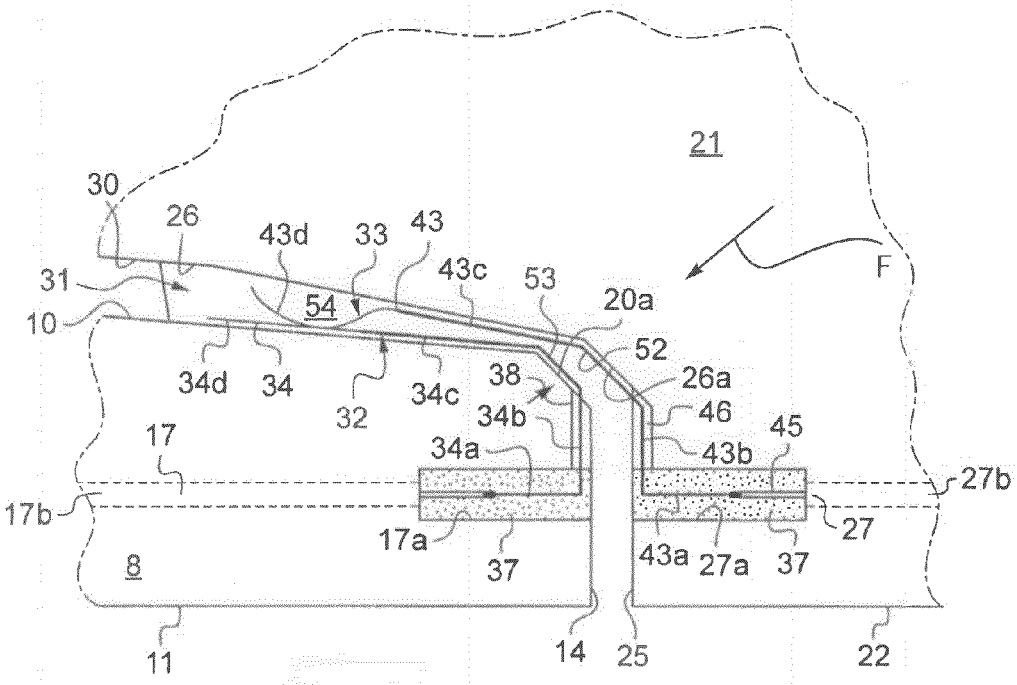
Fig. 6

TUBULAR COMPONENT HAVING AN ELECTRICALLY INSULATED LINK PORTION WITH A DIELECTRIC DEFINING AN ANNULAR SEALING SURFACE

This application is based upon and claims the benefit of priority from prior French Patent Application No. 10/04446, filed Nov. 16, 2010, the entire contents of which are incorporated herein by reference.

The invention relates to the field of exploration and operation of oil or gas fields, in which rotary drillpipe strings constituted by tubular components such as standard drillpipes, which may be heavy weight, and other tubular elements are used, in particular drill collars in the bottom hole assembly, connected end to end in a manner appropriate to drilling requirements.

More particularly, the invention relates to a profiled element for rotary drilling equipment such as a pipe or a heavy weight pipe disposed in the body of a rotary pipe string.

Such assemblies can in particular be used to produce deviated boreholes, i.e. boreholes with an inclination to the vertical or the horizontal which can be varied during drilling. Deviated holes can currently reach depths of the order of 2 to 6 kilometers and horizontal distances of the order of 2 to 14 kilometers.

In the case of a deviated hole of this type, comprising practically horizontal sections, the frictional torques due to rotation of the drillpipe string in the well can reach very high values during drilling. The frictional torques may compromise the equipment used or the drilling objectives. Further, pulling out the debris produced by drilling is very often difficult, in particular in the portion of the drilled hole that is steeply inclined to the vertical. The mechanical stress on the tubular components is increased.

In order to provide a better understanding of the events occurring at the hole bottom, the bottom hole assemblies close to the drill bit can be provided with measuring instruments. Various sensors may be used to measure parameters relating to the geological formations at the hole bottom, the condition of the tools, the operating conditions, etc. The data measured are very useful for the operators located at the surface, in particular in order to determine the drilling parameters such as the direction, penetration rate, etc. The measured data are transmitted to the surface via electrical cables integrated into the components of the drill stem. Induction couplers may be used to transmit the data across the junctions of the drill stem. However, electromagnetic couplers often lack reliability in terms of signal degradation and a short service lifetime.

Electrical contacts between components have been described in: U.S. Pat. No. 3,170,137, U.S. Pat. No. 3,518,608, U.S. Pat. No. 3,696,332, U.S. Pat. No. 3,879,097, U.S. Pat. No. 4,095,865, U.S. Pat. No. 4,444,5735, U.S. Pat. No. RE 39,259 and U.S. Pat. No. 7,226,090.

Document U.S. Pat. No. 7,114,970 describes a drill stem with an electrical conductor. Between two components of the stem, electrical conductors are exposed to deterioration during makeup. Many parts are required to provide electrical continuity. The conductive rings are embedded and open radially on the outside of a first, male, end of a tubular component, while they open radially inwardly of a second, female, end of a complementary tubular component. A very precise radial adjustment to makeup of the conducting rings in contact is necessary. The electrical contact is likely to deteriorate in the event of buckling of the drill stem, or vibrations, or high temperatures, etc. In that document, when two components are connected, a sealed annular zone is produced to house therein the threadings and said conducting rings in electrical contact. In order for the connection zone to remain sealed, the signal transmission cable connected to those conducting rings must itself remain sealed to the outside and inside of those connected tubular components. Such a structure constitutes a constraint, as it necessitates the provision of a bore which is sealed over the entire length of the tubular component in order to accommodate said cable therein in a sealed manner.

The invention improves this situation. One advantage of the invention is that it can be used to provide an electrical connection in a protected zone without necessitating protection of the transmission cable itself. The invention provides a tubular component of a drill stem comprising—a first end comprising a first threading, a second end comprising a second threading, and a substantially tubular central zone. The component comprises an electrical connecting device for electrical connection with another component, mounted on at least one of the ends, and a cable for the transmission of signals between the first end and the second end, connected to the connecting device. The connecting device comprises at least one conductor provided with an electrically insulated link portion connected to the transmission cable and an electrical contact portion in the extension of the insulated link portion. In particular, the electrical contact portion comprises a bare portion. The connecting device comprises a dielectric means to isolate the insulated link portion.

The connecting device comprises an annular sealing surface defining a protected zone, said electrical contact portion being disposed in the protected zone, the annular sealing surface being disposed at the surface of the insulated link portion. The term "at the surface of the insulated link portion" means a free surface of the dielectric means at the position of the insulated link portion on the axis of the component. The spatial separation of the seal and the electrical continuity mean that the reliability of at least the electrical contact, and in general the seal, is improved. The protected zone offers a vast volume compared with the bulk of the electrical continuity members, so the electrical contact is mechanically resilient, providing at least radial pre-loading which is permanent when made up.

The insulated link portion together with the dielectric means may define at least one annular surface about the longitudinal axis intended to form an annular sealing surface in order to define, at least in part, an annular protected zone such that said electrical contact portion is disposed in the protected zone and the annular sealing surface cooperates with an annular sealing surface of a complementary tubular component when the tubular component is connected with such a complementary tubular component.

As an example, the annular sealing surface may be formed at the radial periphery of an annular assembly formed by the insulated link portion and the dielectric means.

The invention also concerns a tubular component of a drill stem, comprising a first end comprising a first threading, a second end comprising a second threading, and a central substantially tubular zone along a longitudinal axis, the component further comprising an electrical connecting device for electrical connection with another component, mounted on at least one of its ends, and a cable for the transmission of signals between the first end and the second end, connected to the connecting device, the connecting device comprising:

- at least one conductor provided with an electrically insulated link portion connected to the transmission cable and an electrical contact portion in the extension of the insulated link portion; and
- a dielectric means to isolate the insulated link portion;

characterized in that it comprises an interposed part fixed to said end comprising the electrical connecting device such that a radial portion of said interposed part defines at least one annular surface about the longitudinal axis intended to form an annular sealing surface in order to define, at least in part, an annular protected zone, such that said electrical contact portion is disposed in the protected zone, and the annular sealing surface cooperates with an annular sealing surface of a complementary tubular component when the tubular component is connected with such a complementary tubular component.

Advantageously, in the connected position of the tubular components, the annular sealing surface of one tubular component may be disposed in a manner which is concentric with the annular sealing surface of a complementary tubular component with which it is connected.

Advantageously, both the insulated link portion and the dielectric means may comprise an annular structure. Hence, these structures are radially superimposed and define said annular surface. Thus, a set of structures which is circumferentially homogeneous relative to the longitudinal axis is obtained. A compressive force applied to this annular surface, set up in particular as the tubular component is being connected to said complementary tubular component, provides the seal for the protected zone. Preferably, the compressive force is applied radially to the annular surface.

In one embodiment, said conductor may be formed as one piece.

In one embodiment, the dielectric means may be formed as one piece.

In one embodiment, said conductor may be provided with a substantially radial electrically insulated portion. In particular, said insulated link portion is provided with said portion which is substantially radial relative to the longitudinal axis.

In one embodiment, said bare zone and a bare zone of a conductor of a complementary electrical connecting device are in mutual contact in the protected zone when connected. Said contact may be elastic.

In one embodiment, at least one conductor comprises a pointed or tapered portion within said electrical contact portion. Said pointed portion is configured so that it can reach an electrical contact portion of a conductor of a complementary electrical connecting device by passing through the dielectric means. Said pointed portion may have the shape of a point, blade, wedge, cross, star, circle, etc.

In one embodiment, each conductor is surrounded by a dielectric means in the insulated link portion and in the substantially radial insulated portion.

In another embodiment, said conductor comprises one sheath per conductor.

In one embodiment, the electrical connecting device comprises two conductors, each provided with a bare zone, said bare zones being axially offset so that they are respectively in contact with the bare zones of a complementary device when connected, a common insulator being disposed between the insulated link portions of the conductors. A bare zone of a conductor may comprise an elastic boss provided to cooperate, when connected, with an annular surface of a corresponding bare zone of another complementary conductor.

In one embodiment, the insulated link portion is annular over at least a portion of its length. The insulated link portion may be cylindrical, radial or tapered.

In one embodiment, a sealing ring is disposed in contact with the insulated link portion. Part of the sealing ring may be disposed in a housing provided by the insulated link portion.

In one embodiment, the electrical contact portion is annular.

In another embodiment, the electrical contact portion comprises a plurality of regularly distributed angular sectors.

In one embodiment, the electrical contact portion comprises an angular sector.

In one embodiment, the device comprises at least two conductors and a block disposed in the protected zone to keep the electrical contact portions of the conductors apart.

In one embodiment, one end is male, the annular sealing surface being disposed on the outer surface of the insulated link portion.

In one embodiment, one end is female, the annular sealing surface being disposed on the inner surface of the insulated link portion.

In one embodiment, the connecting device is connected to the communication cable in a cavity provided in an axial abutment surface of the corresponding end and the conductor is provided with an insulated substantially axial portion inserted in said cavity.

In one embodiment, the dielectric means comprises at least one layer disposed between a metal surface of said end and a conductor, and at least one layer disposed on the side of the conductor opposite to the metal surface and forming said annular sealing surface.

In one embodiment, the first end is male and the second end is female. The component may comprise a male electrical connecting device at the first end and a female electrical connecting device at the second end, the signal transmission cable being connected to the male and female connecting devices. The component may be a tube with a length in the range 6 to 21 meters, for example in the range 10 to 13 meters.

In another embodiment, the first end is female and the second end is female. The component may comprise a female electrical connecting device at each end, the signal transmission cable being connected to the connecting devices. The component may be a coupling with a length of less than 5 meters.

In another embodiment, the first end is male and the second end is male. The component may comprise a male electrical connecting device at the first end and a male electrical connecting device at the second end, the signal transmission cable being connected to the connecting devices.

In one embodiment, the component comprises a single conductor. The bare zone is provided so that it can make contact with the complementary bare zone of another component when connected.

In another embodiment, the device comprises two conductors, each provided with a bare zone. Said bare zones are axially offset, so that when connected they are respectively in contact with the bare zones of a complementary device. A common insulator is disposed between the insulated link portions of the conductors.

In one embodiment, the electrical contact portion is generally tapered in shape with an inclination in the range 5° to 20°. Said insulated substantially radial portion may occupy an angular sector of less than 20°. The insulated link portion may be annular.

In one embodiment, the male and female devices have an equal number of conductors. The electrical contact portion of one of the devices, male or female, may not be substantially annular, for example a circular arc occupying at least an angular sector of less than 180°, in particular less than 30°.

An electrical junction may comprise two components as described above, and an interposed sealing part, if necessary provided with at least one sealing ring. The interposed part is disposed between the male connecting device of one of the components and the female connecting device of another component. The interposed part may be removable. The interposed part may be annular.

In one embodiment, the interposed part has a rectangular section, a sealing ring being disposed between two substantially radial surfaces and a sealing ring being disposed between two tapered surfaces.

In another embodiment, the interposed part has an L-shaped section with an axial portion, a sealing ring projecting from an outer surface of the axial portion and a sealing ring projecting from an inner surface of the axial portion.

An electrical junction may comprise two components as described above providing electrical continuity between the signal transmission cables of said components.

The present invention will be better understood from the following detailed description of several embodiments which constitute non-limiting examples and are illustrated in the accompanying drawings in which:

FIG. 1 is a partial view of a drill stem;

FIG. 2 is an axial sectional view of a connection between components;

Figure 3A:
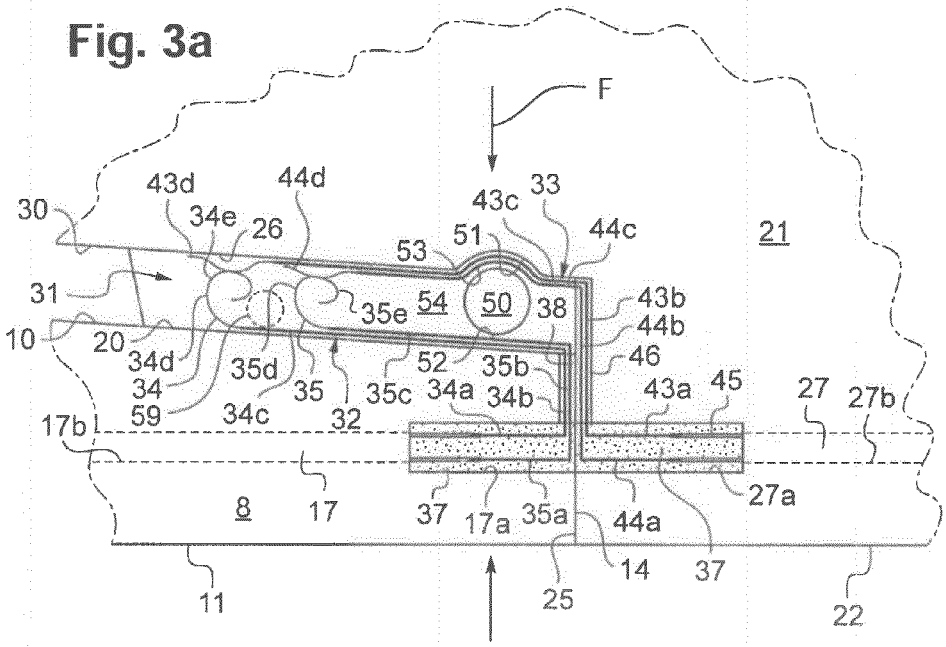
Figure 3B:
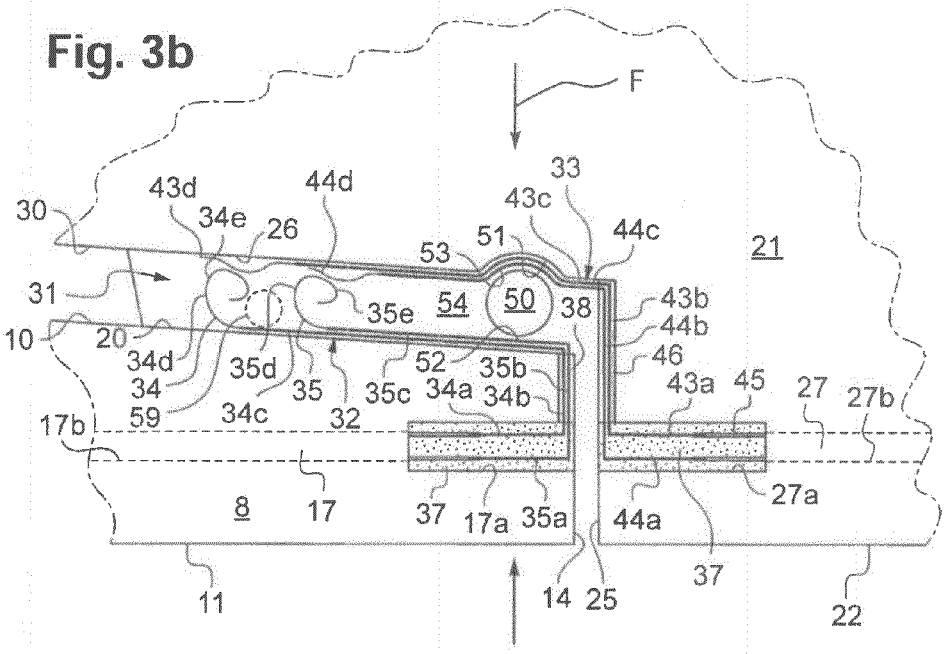
Figure 4A:
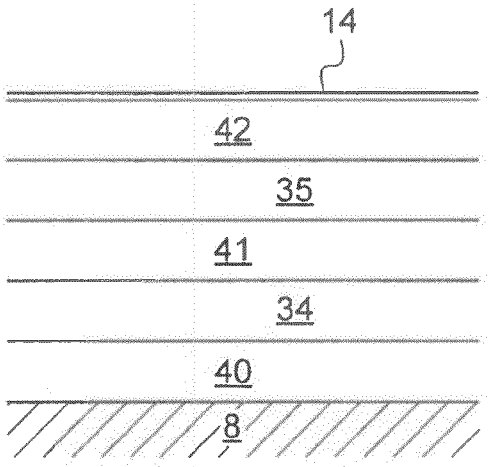
Figure 4B:
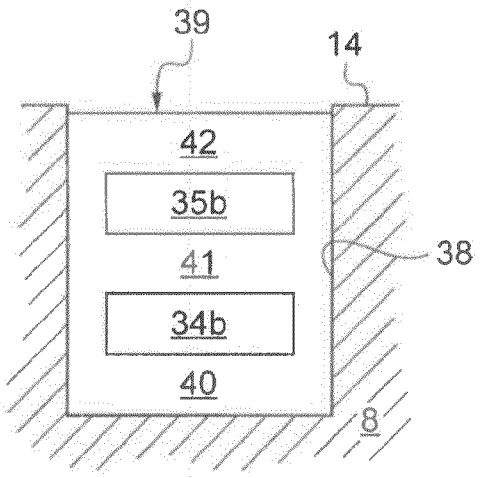
Figure 4C:
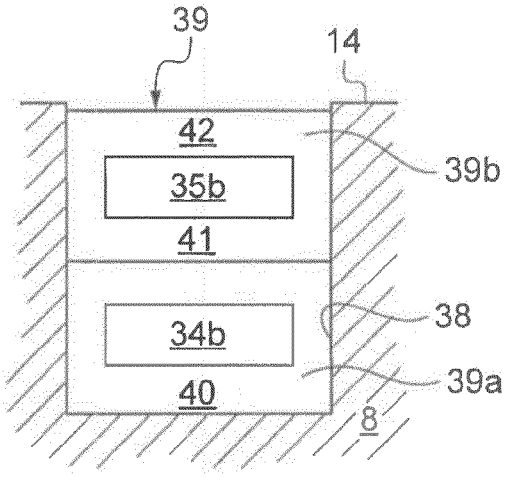

FIGS. 3*a* and 3*b* are axial sectional half views of an electrical connecting device in a connection when made up and during makeup;

FIGS. 4*a* and 4*b* are detailed views of conductors in the device of FIG. 3 in section in perpendicular planes, respectively axial and parallel to the axis, and FIG. 4*c* is a variation of that shown in FIG. 4*b;*

Figure 7:
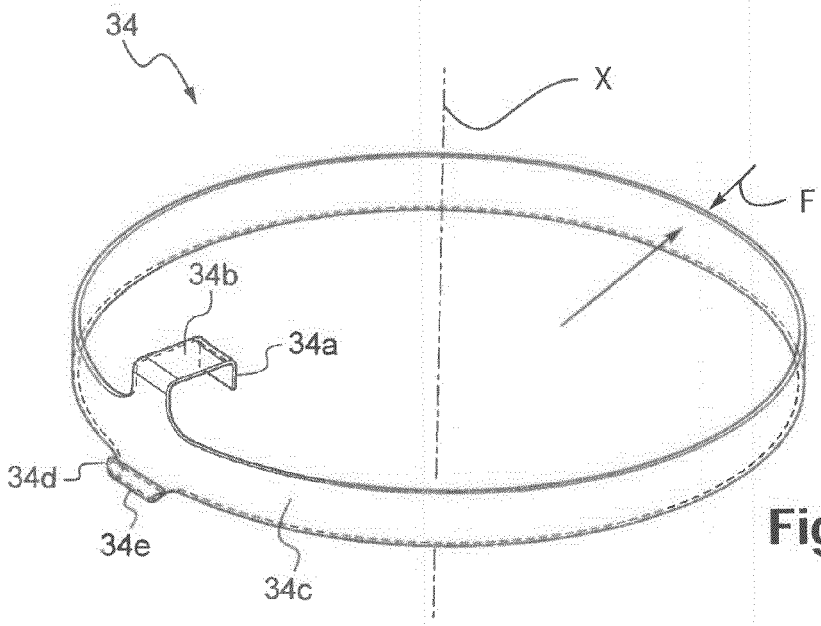
Figure 8:
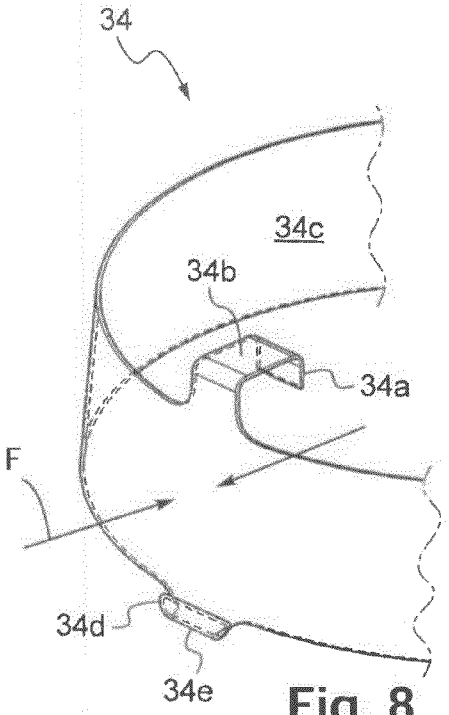
Figure 9:
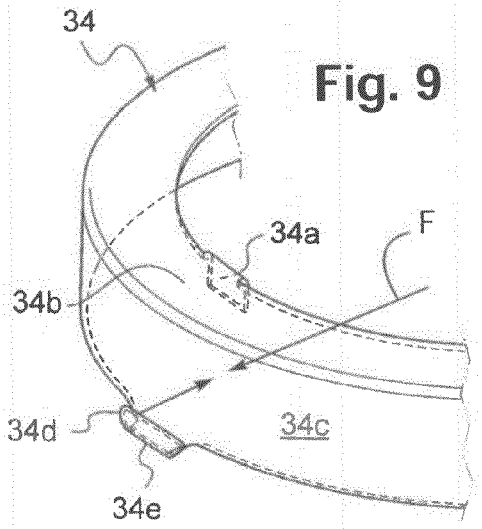
Figure 10:
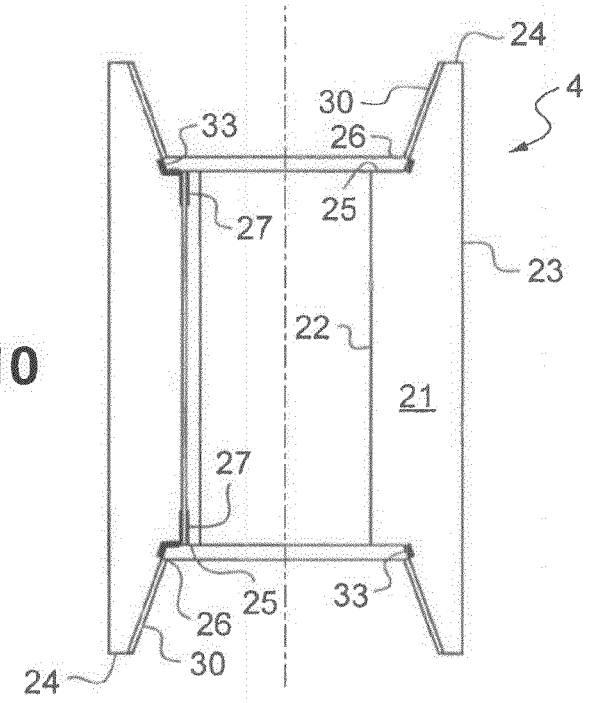
Figure 11:
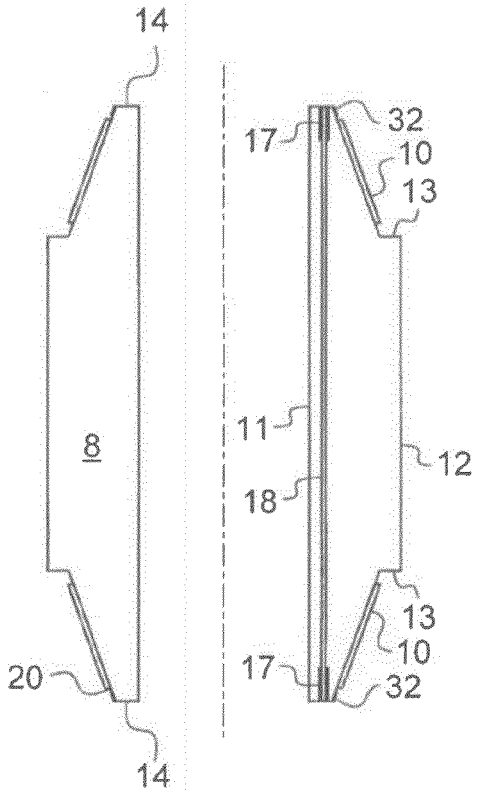
Figure 12:
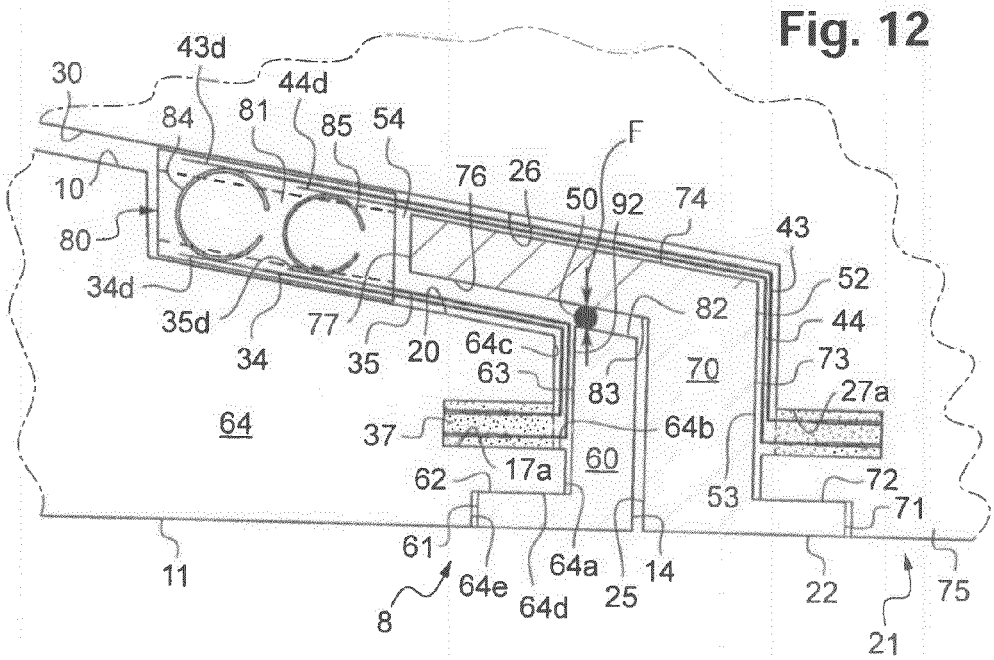

FIG. 5 shows a variation of the conductor of FIG. 3;

FIG. 6 shows a variation of FIG. 3 devoid of the sealing ring;

FIG. 7 is a perspective view of a conductor;

FIG. 8 is a detailed view of FIG. 7;

FIG. 9 shows a variation of FIG. 8;

FIG. 10 is an axial sectional view of a coupling with female ends;

FIG. 11 is an axial sectional view of a connection with male ends;

FIG. 12 shows a variation of FIG. 3 with applied abutments; and

Figure 13:
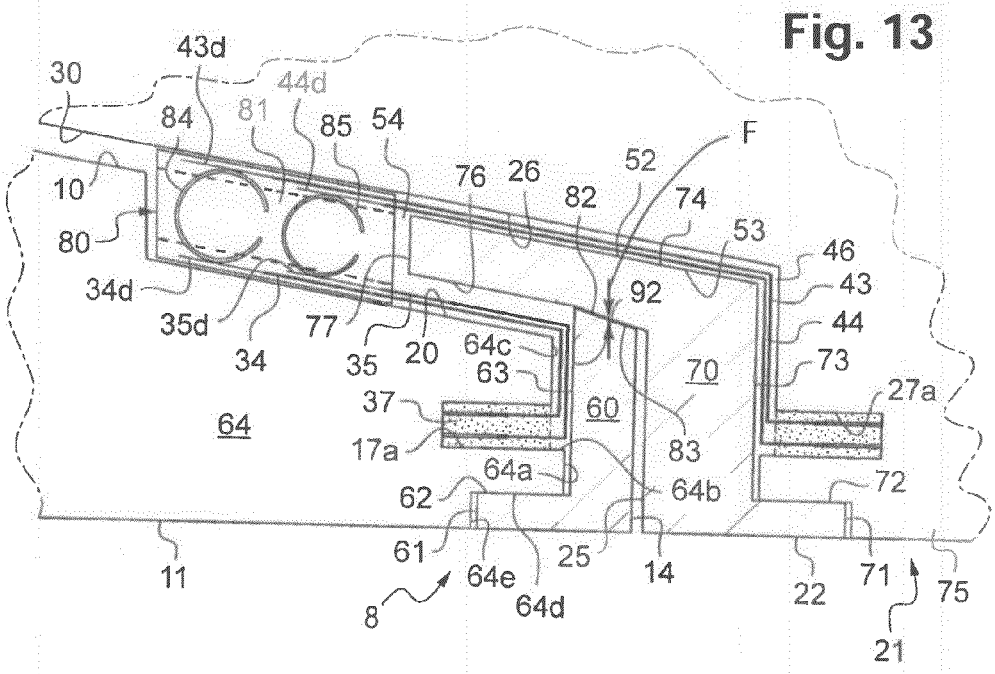

FIG. 13 is a sectional view of a variation of FIG. 12.

The drawings contain elements of a concrete nature. However, they not only serve to provide a better understanding of the present invention, but also contribute to its definition if necessary.

When drilling a well, a rig is disposed on the ground or on an offshore platform to drill a hole into the strata of the ground. A drill stem 1, see FIG. 1, is suspended in the hole and comprises a drilling tool, such as a drill bit, 5 at its lower end. The drill stem 1, see FIG. 1, comprises a bottom hole assembly 2 and a drillpipe string 3 disposed between the bottom hole assembly 2 and the surface. The drill stem is driven in rotation by a drive mechanism, which may be hydraulic, for example. The drive mechanism may comprise a kelly with an upper end of the drill stem. The drill stem is suspended on a hook attached to a block via the kelly and a rotary head allowing the drill stem to rotate with respect to the hook.

Drilling fluid or mud is stored in a reservoir. A mud pump sends drilling fluid into the drill stem via an orifice of the injection head, forcing the drilling fluid to flow downwards through the drill stem. The drilling fluid then leaves the drill stem via channels in the drill bit then rises in the generally annularly shaped space formed between the outside of the drill stem and the wall of the hole. The drilling fluid lubricates the drilling tool and brings the drilling debris released by the drill bit at the hole bottom to the surface. The drilling fluid is then filtered so that it can be used again. The drillpipe string 3 comprises a plurality of pipes (tubular components) 7 that may include standard pipes obtained by connecting a male end, a great length tube and a female end on the side opposite to the first end by welding to form, on connection, leak-proof threaded tubular connections and possibly heavy weight drillpipe. A pipe may be of the type in accordance with specification API 7 from the American Petroleum Institute or in accordance with the manufacturer's designs. The drillpipe string 3 and the bottom hole assembly 2 in this case are connected via a short coupling 4.

The bottom hole assembly 2 may comprise a drill bit 5 and drill collars 6; their weight causes the drill bit 5 to bear against the hole bottom. The bottom hole assembly 2 may also comprise measuring sensors, for example for measuring pressure, temperature, stress, inclination, resistivity, etc. Other elements of the drill stem 1, for example one or more drill collars 6, one or more pipes 7, may also be provided with measuring sensors. The transmission of information between the sensors and the surface necessitates a higher data flow rate than is possible with wireless pressure pulse transmission through the mud. Information transmission is in real time or very slightly different because simple storage in a memory and reading of the memory when the component is removed from the hole is insufficient. Signals from the sensors can be sent to the surface via a cabled telemetry system. The drillpipe may be provided with a protected communication cable, for example of the type illustrated in documents U.S. Pat. No. 6,670,880, U.S. Pat. No. 6,717,501, US 2005/0115717, US 2006/0225926, US 2005/0092499 or FR 2 883 915.

In particular, the invention proposes a link that can transmit data from one component to another, independently of the relative angular position of the adjacent components, in a reliable manner over time and over the length of a drill stem-while keeping the cross section of flow high and keeping the thickness of the ends of the tubular components small. The invention also provides a circumferentially sealed connection, in particular by proposing an annular surface with a uniform bearing stiffness at the location of the line of the seal between the inside and the outside of the drill stem.

As can be seen in FIG. 2, a pipe 7 comprises a first male end 8 and a tubular body 9. The tubular body 9 may be connected to a female end at the side opposite to the first end 8. The first end 8 and the tubular body 9 may be welded, in particular by friction. The first end 8 comprises a male threading 10 provided on an outer surface, for example substantially tapered. The first end 8 also comprises a bore 11, an outer surface 12, a shoulder 13, for example substantially radial, between the male threading and the outer surface 12 and a terminal surface 14, for example substantially radial, between the bore 11 and a tapered surface 20 extending the male threading 10 opposite to the shoulder 13.

The bore 11 and the outer surface 12 may be cylinders of revolution about a longitudinal axis X, and may be concentric. The first end 8 is connected to the tubular body 9 via a substantially tapered inner surface 15 and an outer substantially tapered surface 16. The bore 9*a* of the tubular body 9 is in this case a standard drillpipe with a diameter that is greater than the diameter of the bore 11. The external diameter of the tubular body 9 in this case is smaller than the diameter of the outer surface 12 of the first end 8. The tapered surface 20 extends from the large diameter end of the terminal surface 14. The taper of the tapered surface 20 may be in the range 5° to 20°, which may be different from the taper of the male threading 10. The tapered surface 20 and the male threading 10 in this case have substantially equal tapers.

A cavity 17 extends principally axially from the terminal surface 14, in particular in the form of a cylinder of revolution or an annular groove. The cavity 17 in this case is a hole opening inside the pipe 7 beyond the bore 11 into an inner surface 15. The cavity 17 may comprise a first hole 17*a* close to the terminal surface 14 and a second hole 17*b* close to the inner surface 15. The diameter of the first hole 17*a* is greater than the diameter of the second hole 17*b*. The first hole 17*a* is short compared with the length of the second hole 17*b*. The first hole 17*a* is shorter than the tapered surface 20, see FIGS. 3*a* and 3*b*.

At least one communication cable 18 passes through the cavity 17 and through the length of the first end 8. Optionally, the hole for the passage of the communication cable 18 may have a slight inclination, for example with respect to a plane passing through the axis and/or in a plane passing through the axis. The communication cable 18 is connected to a male connecting device 32 in the first hole 17*a* and is protected from drilling mud moving in the bore of the pipe 7 by the thickness of material in the first end 8.

The pipe 7 comprises a protective tube 19 surrounding the communication cable 18 in the tubular body zone 9. The protective tube 19 may be in contact with the bore 9*a* of the tubular body 9. The protective tube 19 may be fixed, for example, by push fitting into an enlarged zone of the hole for the passage of the communication cable 18 close to the connecting surface 15. The protective tube 19 may have one end push fitted into the hole for the passage of the communication cable 18, with an opposite end push fitted into the corresponding hole of the female end of the pipe 7 and a regular portion in the bore of the tubular body 9.

A second female end 21 forms part of a pipe 107, for example, identical to the pipe 7. The second end 21 comprises a bore 22, an outer surface 23, a large diameter terminal surface 24 which is substantially radial in shape extending from the outer surface 23, a small diameter shoulder 25, which is substantially radial and extends from the bore 22, a female threading 30 matching the male threading 10 and extending substantially from the terminal surface 24 inwardly, and a tapered surface 26 facing the tapered surface 20 when made up and extending from the small diameter end of the shoulder 25. The second end 21 connects to the tubular body 9 of the pipe 107 via a substantially tapered inner surface and a substantially tapered outer surface on the side axially opposite to the first end 8 in the case of FIG. 2. The first end 8 and the tubular body 9 may be welded, in particular by friction. In FIG. 3*a* which represents the made up condition, the terminal surface 14 and the shoulder 25 are in abutting contact. In FIG. 3*b*, which represents the prior art at the end of makeup, the terminal surface 14 and the shoulder 25 are separated.

Alternatively, the second end 21 may form part of a coupling 4, for example a coupling with two female ends, see FIG. 10. The two female ends are substantially identical. The first end may form part of a connection, for example a connection with two male ends, see FIG. 11. The two male ends are substantially identical.

A cavity 27 extends axially from the shoulder 25, in particular in the form of hole which is a cylinder of revolution which is axial or slightly inclined, or an annular groove. The cavity 27 in this case is a hole opening inside the pipe 107 beyond the bore 22 into an inner surface 15. The cavity 27 may comprise a first hole 27*a* close to the terminal surface 24 and a second hole 27*b* close to the inner surface, see FIGS. 3*a* and 3*b*. The first hole is short compared with the length of the second hole. The first hole is shorter than the length of the tapered surface 26. In FIGS. 3*a* and 3*b*, the cavities 17 and 27 have been shown facing each other for better comprehension. However, the respective sectional planes of the first end 8 and the second end 21 may be offset angularly. The relative angular position of the cavities 17 and 27 is of no relevance. This is also the case as regards their radial position.

At least one communication cable 28 similar to the communication cable 18 passes through the cavity 27 and through the length of the second end 21. The communication cable 28 is connected to a female connecting device in the first hole 27*a* and is protected against drilling mud moving in the bore of the pipe 107 by the thickness of the material of the second end 21. The pipe 107 comprises a protective tube 29 similar to the protective tube 19.

The connecting system 31 comprises a male device 32 and a female device 33. In general in FIGS. 3*a*, 3*b*, 5 and 6, the male 32 and female 33 elements are shown as being at a small distance from the male 8 and female 21 ends to make the drawing understandable. It should be noted that the male 32 and female 33 devices are in contact with the first and second ends 8 and 21, in particular with the tapered surfaces 20 and 26, when made up. Similarly, the first and second ends 8 and 21 may be in mutual contact via a surface 14 and the shoulder 25.

The male connecting device 32 comprises two conductors 34, 35 insulated by a dielectric means 39, in this case comprising three layers of insulator 40, 41 and 42, see FIGS. 4*a* and 4*b*. Each layer of insulator 40, 41, 42 may be in the form of a coating adhering to the conductor. The coating may be a paint or a varnish. The layers of insulator 40, 41 and 42 form a dielectric means. The dielectric means 39 is formed as one piece. As an example, the thin edges of the layers of insulator 40, 41 and 42 are connected over angularly limited portions of the conductors 34, 35, see FIG. 4*b*. The dielectric means 39 also provides for electrical insulation of the link portions 34*c*, 35*c*, included in the annular zone of the link portions 34*c*, 35*c*. The electrically insulated link portions of the conductors 34 and 35 are isolated by the dielectric means 39.

The dielectric means 39 may include an electrically insulating synthetic material, for example polytetrafluoroethylene (PTFE). The layers of insulator 40, 41 and 42 provide a seal at least to liquids. The conductors 34, 35 have a generally flat structure, formed by folding. The conductors 34, 35 may be produced by cutting a tube or by pressing a sheet, in particular a copper-based sheet. In the variation of FIG. 4*c*, the dielectric means 39 is produced in two portions 39*a* and 39*b*, one surrounding the conductor 34, the other surrounding the conductor 35 in the manner of a sheath. The two portions 39*a* and 39*b* are in mutual contact via a surface which is substantially parallel to the terminal surface 14.

The conductor 34 comprises an end 34*a* inserted in the first hole 17*a* of the cavity 17. The end 34*a* may occupy a small angular sector, for example of the order of 1° to 20°. The end 34*a* is electrically connected to a conductor (wire) of the communication cable 18. The communication cable 18 is dual-wired in the embodiment of FIG. 3, and single-wired in the embodiments of FIGS. 5 and 6. The conductor 34 comprises a substantially radial portion 34*b*, which is electrically insulated, in particular between the insulators 40 and 41. The substantially radial portion 34*b* extends from the end 34*a* radially outwardly. The substantially radial portion 34*b* may occupy an angular sector close to the angular sector of the end 34*a*, for example in the range 1° to 20°. The substantially radial portion 34*b* is disposed in a radial groove 38 provided in the first end 8 from the terminal surface 14. The groove 38 extends radially between the first hole 17*a* and the tapered surface 20 of the first end 8. The depth of the groove 38 is slightly greater than the thickness of the conductors 34 and 35 and the insulators 40 to 42. Thus, when two pipes are connected, and the terminal surface 14 of the first end 8 of a pipe comes to bear against the terminal surface 21 of the shoulder 25, no contact pressure is exerted directly on that substantially radial portion 34*b* of the conductor. Viewed in section in the groove 38, the male portion is in the form of an insulator-conductor laminate comprising at least N+1 insulators per N conductors, where N is a whole number; in FIGS. 3, 4*a* and 4*b*, N=2 and in FIGS. 5 and 6, N=1.

The conductor 34 comprises an electrically insulated link portion 34*c* in the extension of the electrically insulated link portion 34*b* and substantially radial. The link portion 34*c* is at least partially annular in shape, in particular tapered, matching the surface 20. The link portion 34*c* extends from the substantially radial portion 34*b* radially outwardly and axially away from the terminal surface 14. The link portion 34*c*, which has a simple shape, produces a good seal. The link portion 34*c* is disposed around the tapered surface 20 of the first end 8. The insulating layer 40 is engaged with and locally interference fitted between the tapered surface 20 and the link portion 34*c*. The insulating layers 40, 41 and 42 at the link portions 34*c* and 35*c* are also annular in shape, in particular tapered, and respectively match the link portions 34*c* and 35*c*. At this outer tapered portion of the first end 8, the conductors 34 and 35 are in the form of a stack of concentric annular layers of insulator and conductor. The link portion 34*c* extends from the large diameter end of the substantially radial portion 34*b*, for example over a length of the order of 20 to 50 mm.

The conductor 34 comprises an at least partially bare electrical contact portion 34*d*. The electrical contact portion 34*d* is located in the extension of the link portion 34*c* opposite to the substantially radial portion 34*b*. In the embodiment illustrated in FIG. 3, the contact portion 34*d* has a shape which is curled into a spiral, in section in an axial plane, providing a rounded surface with a convex zone 34*c* directed outwardly. The spiral is oriented outwardly. The convex zone 34*e* has strong radial elasticity, promoting reliable electrical contact. The spiral may make an angle of the order of 270° to 360°. The contact portion 34*d* may be annular or occupy one or more limited angular sectors, for example 1° to 10°, circumferentially regularly distributed. In another embodiment, the contact portion 34*d* has a bulged curved shape also providing a rounded surface with an outwardly directed convex surface. FIGS. 7 to 9 also illustrate the structure of the conductors.

In the variation of FIG. 8, the length of the link portion 34*c* is greater than in the other embodiments. The link portion 34*c* is annular over a portion of its length and occupies a limited angular sector in the vicinity of the insulated portion 34*b*, over another portion of its length.

In the variation of FIG. 9, the substantially radial portion 34*b* is annular. The link portion 34*c* is annular up to the substantially radial portion 34*b*. The corresponding portion of the male connecting device 32 may be annular.

The conductor 35 has a similar structure to that of the conductor 34 and partially surrounds it. The conductor 35 comprises an end 35*a* connected to the electrical cable 18 in the first hole 17*a*, occupying an angular sector of the order of 1° to 20°, a substantially radial insulated portion 35*b* disposed in the groove 38, occupying an angular sector of the order of 1° to 20°, an insulated link portion with a generally annular shape 35*c* and an electrical contact portion 35*d*, disposed between the electrical contact portion 34*d* occupying an angular sector of the order of 1° to 10° and the terminal surface 14 of the first end 8. The electrical contact portion 35*d* is bare. The electrical contact portion 35*d* comprises an outwardly directed convex zone 35*e*. The remainder of the first hole 17*a* may be blocked by an insulating filler material 37. The length of the link portion 35*c* is substantially less than the length of the link portion 34*c* such that a significant axial offset exists between the contact portions 34*d* and 35*d*, ensuring electrical insulation of the contact portions 34*d* and 35*d* of the conductors 34 and 35. Said axial offset may be in the range 10 to 20 mm. The contact portion 35*d* has a similar shape to the contact portion 34*d*. In general, the conductor 34 is disposed nearer to the first end 8, while the conductor 35 is superimposed on the conductor 34 on the outside of the first end 8. The same dielectric means 39 provides the insulation for the conductors 34 and 35.

Optionally, an annular seal 59, shown in dotted lines, which may be toroidal, formed from a dielectric material, may be disposed axially between the contact portions 34*d* and 35*d*. The annular seal may be formed from an impermeable material. The annular seal may be formed from a plastically or elastically deformable material. The annular seal may have a structure and be formed from a material that provides a seal at least to liquids.

As can be seen in FIGS. 4*a* and 4*b*, the insulated portions of each conductor 34, 35 are isolated by two layers of insulator of the dielectric means 39, in particular in the groove 38. A layer of insulator 41 may be common to the conductors 34 and 35. In other words, in axial section, an insulator 40 is disposed between the conductor 34 and the first end 8, an insulator 41 is disposed between the conductors 34 and 35, and an insulator 42 is disposed on the outside of the conductor 35. The one-piece construction of the dielectric means 39 is visible in FIG. 4*b*, the edge of the conductors 34 and 35 being separated from the edges of the groove 38 by a thickness of insulator joining the insulating layers 40 and 41, 41 and 42.

The male connecting device 32 has a contact surface with the first end 8, formed by the inner face of the insulator 40, and an outer surface formed by the outer face of the insulator 42. Said outer surface comprises a first region, which is radial and corresponds to the radial portions 34*b* and 35*b*, which is flush with the terminal surface 14 or set back slightly therefrom. Said outer surface comprises a second region with a shape that matches the surface 20. Said second region defines an annular sealing surface 52. The sealing surface 52 may be tapered, cylindrical, or concave (rounded or otherwise). The sealing surface 52 is defined by a radially outer surface of the dielectric means surrounding the annular link portions 34*c* and 35*c*.

The female device 33 of the connecting system 31 comprises a conductor 43 and a conductor 44, see FIGS. 3*a* and 3*b*, and a dielectric means 39, see FIGS. 4*a* and 4*b*. In general, the female device 33 is in the form of a laminate in axial section of N conductors and N+1 insulators. In the embodiment of FIG. 3, the conductor 43 comprises an end portion 43*a* electrically connected to a wire of a communication cable 28. The end 43*a* is disposed in the first hole 27*a* of the cavity 27. The end 43*a* occupies a limited angular sector, for example in the range 1° to 20°. The conductor 43 comprises a substantially radial portion 43*b* which is orientated outwardly from the end portion 43*a*. The substantially radial portion 43*b* is housed in a substantially radial groove 46 provided from the shoulder 25 of the second end 21. The groove 46 extends between the cavity 27 and the substantially tapered surface 30. The substantially radial portion 43*b* occupies a limited angular sector, for example in the range 1° to 20°. The remainder of the cavity 27 is filled with insulating filler material 37.

The conductor 43, in this case formed as one piece, comprises an insulated link portion 43 with a shape that matches the surface 26. The link portion 43*c* is at least partially annular in shape. The conductor 43 comprises a bare contact portion 43*d* formed at the end of the link portion 43*c* opposite to the substantially radial portion 43*b*. When made up, the contact portion 43*d* is electrically connected to the contact portion 34*d* of the conductor 34. The contact portion 43*d* may have an annular shape matching the tapered surface 26 of the second end 21 or projecting slightly radially inwardly. The contact portion 34*d*, with a curved shape, will exert an elastic contact force on the inwardly orientated surface of the contact portion 43*d* when connected. The contact portion 34*d* can deform elastically over a radial path of approximately 0.3 to 2 mm. During makeup, the contact portions 34*d* and 43*d* slide over each other because of their shapes.

The conductor 44 has a structure, in this case formed as one piece, which is analogous to the structure of the conductor 43. The conductor 44 comprises an end portion 44*a* inserted in the first hole 27*a* of the cavity 27. The end portion 44*a* is connected to another conductor (wire) of the communication cable 28. The end portion 44*a* may occupy a small angular sector, for example of the order of 1° to 20°. The conductor 44 comprises a substantially radial portion 44*b*, which is electrically insulated. The substantially radial portion 44*b* may occupy an angular sector close to the angular sector of the end 44*a*, for example of the order of 1° to 20°. The substantially radial portion 44*b* extends radially outwardly from the end portion 44*a*. The insulating material may comprise PTFE. The substantially radial portion 44*b* is disposed in the radial groove 46. The depth of the groove 46 is slightly greater than the thickness of the conductors 43 and 44 and the insulators.

The conductor 44 is similar to the conductor 43. The conductor 44 comprises an electrically insulated link portion 44*c*. The link portion 44*c* has a shape which is at least partially annular. The link portion 44*c* is disposed inside the link portion 43*c*. The link portion 44*c* extends from the large diameter end of the substantially radial portion 44*b*, for example over a length of the order of 10 to 30 millimeters. The conductor 44 comprises an electrical contact portion 44*d* that is at least partially bare. The electrical contact portion 44*d* extends the link portion 44*c* opposite to the substantially radial portion 44*b*. In the embodiment illustrated in FIG. 3, the contact portion 44*d* has an annular shape. The electrical contact portion 44*d* is in contact with the outwardly directed convex zone 35*e*, when made up. The same dielectric means provides insulation of the conductors 43 and 44. The electrical insulation of the insulated portions 44*b* and 44*c* is provided by a dielectric means similar to the above.

The conductors 34, 35, 43 and 44 may be produced from a sheet or a tube. The conductors 34, 35, 43 and 44 may have a thickness of the order of 0.1 to 1 mm. The connecting device 32, 33 is retained on the respective ends 8, 21 by the filler material 37 which, for example, comprises an epoxy resin and/or by bonding the dielectric means onto the respective end 8, 21.

In FIG. 3*a*, representing the condition when made up, the bare zones of the conductors 34 and 43, 35 and 44 are in mutual contact. In FIG. 3*b* representing the prior art at the end of makeup, the bare zone of the conductor 34 is no longer in contact with the bare zone of the conductor 43 and the bare zone of the conductor 35 is no longer in contact with the bare zone of the conductor 44. The bare zone of the conductor 35 is substantially at the insulated link portion 44*c*.

The female connecting device 33 has a contact surface with the second end 21 formed by an inner face of the insulator and an outer surface formed by the outer face of the insulator. Said outer surface comprises a first region which is radial and corresponds to the radial portions 43*b* and 44*b* which are flush with the shoulder 25 or slightly set back. Said outer surface comprises a second region which matches the shape of the tapered surface 26. Said second region defines an annular sealing surface 53. The sealing surface 53 is defined by a radially inner surface of the dielectric means surrounding the annular link portions 43*c* and 44*c*.

A sealing ring 50 is disposed between the male 8 and female 21 ends, more precisely between the sealing surfaces 52 and 53. The sealing ring 50 may be metallic, for example based on stainless steel, in particular 304L or 316, or synthetic, for example based on nitrile rubber (copolymer of acrylonitrile and butadiene). The sealing ring 50 may be partially housed in a circular groove 51 provided in the second end 21 in the tapered surface 26. The link portions 43*c*, 44*c* and the corresponding insulators form a laminate of thin layers matching the shape of the groove 51. The sealing surface 53 in this case is concave and the sealing surface 52 is tapered. The sealing ring 50 is disposed in the subsisting portion of the groove 51. The groove 51 may have a section that is in the shape of an arc of a circle, for example a semi-circle. The sealing ring 50 is in contact with the male device 32 of the connecting device, in particular with the insulator 42. At the operating pressures for which it is designed, the sealing ring 50 prevents the ingress of mud or liquid from inside the junction. On the side opposite to the inside of the junction, the sealing ring 50 and the sealing surfaces 52 and 53 define a zone 54 which is at least protected against mud. The electrical contact between the conductors 34 and 43, 35 and 44 is disposed in the protected zone 54 to reduce the risks of short-circuiting and corrosion and to provide reliable electrical continuity. Towards the outside of the junction, the protection may be provided by leak-proof threadings or sealing surfaces beyond the threaded zones 10 and 30. Further, the connecting device 31 is capable of withstanding the high temperatures that may be encountered in a well, while ensuring electrical continuity. As can be seen in FIGS. 3*a*, 3*b*, 5 to 9, the compressive force F exerted between the sealing surfaces 52 and 53 principally acts along a radial component which is separate from the axial compressive force by means of which the pipes are connected together.

In FIGS. 3*a* and 3*b*, the sealing ring 50 has been shown with a diameter which is reduced compared with what is actually the case in order to make the sealing surfaces 52 and 53 more clear. The sealing ring 50 is in reality in contact with the sealing surfaces 52 and 53 at the end of makeup, as can be seen in FIG. 5. The conductors 35 and 44 are in contact with the conductors 34 and 43. The conductors 34 and 43 are in contact with the tapered surface 20 and with the groove 51 respectively.

The embodiment of FIG. 5 uses a single conductor with a conductor 34 on the male side and a conductor 43 on the female side. References to similar elements will be the same. The grooves 38 and 46 may be slightly shallower than in the preceding embodiment. The sealing ring 50 is in contact with the sealing surfaces 52 and 53 respectively formed by the insulating layer 41 covering the conductor 34 on the male side and by the corresponding insulating layer covering the conductor 43 on the female side. The electrical contact portion 43*d* is tapered, and its shape matches that of the tapered surface 26. In order to facilitate comprehension, the terminal surface 14 and the shoulder 25 have been shown separated. In reality, the terminal surface 14 and the shoulder 25 are in contact, as shown in FIG. 3*a*.

The embodiment of FIG. 6 is similar to that of FIG. 5, but devoid of a sealing ring. References to similar elements will be the same. The insulating layer 41 covering the conductor 34 on the male side is in direct contact with the corresponding insulating layer covering the conductor 43 on the female side. The seal is provided by said contact between the insulating layers. The sealing surfaces 52 and 53 in this case are in direct contact. The sealing surfaces 52 and 53 are formed on a chamfered zone with an inclination which is greater than the inclination of the tapered surface 26. The electrical contact portion 43*d* is bulged inwardly. The electrical contact portion 34*d* is tapered, matching the shape of the tapered surface 20. In this case, contact between the terminal surface 14 and the terminal surface 25 is optional.

The first end 8 comprises a chamfer 20*a* between the terminal surface 14 and the tapered surface 20. The second end 21 comprises a chamfer 26*a* between the shoulder 25 and the tapered surface 26. The chamfers 20*a* and 26*a* are inclined at approximately 3° to 15° with respect to the axis of the component. The inclination of the chamfers 20*a* and 26*a* may be substantially equal. The chamfer 20*a* may be slightly bulged in axial section, with its inclination being defined by its mean inclination. In FIG. 6, the slope of the chamfers has been increased to make it easier to read. The dimensions of the chamfers 20*a* and 26*a* are such that the insulating surfaces of the link portions 34*c* and 43*c* are in interfering contact to provide a seal at least against mud, or even liquids, or even gases. In order to facilitate comprehension, the terminal surface 14 and the shoulder 25 on the one hand and the chamfers 20 and 26*a* on the other hand have been shown separated. The terminal surface 14 and the shoulder 25 may be in contact, as in FIG. 3*a*. The chamfers 20*a* and 26*a* are in interfering contact.

The embodiment of FIG. 12 is similar to that of FIG. 3 with the exception that the first end 8 comprises a body 64 and a removable tip in the form of an interposed part 60. The interposed part 60 is annular. The end surface 14 is provided on the interposed part 60. A portion of the bore 11 is provided on the interposed part 60. The interposed part 60 is L shaped in axial section. Moving from the bore 11 to an outer surface forming the sealing surface 82, the interposed part 60 comprises a substantially radial surface with a small diameter 61, then a substantially axial or slightly tapered surface 62, then a substantially radial surface with a large diameter 63. The body 64 comprises a substantially radial surface with an intermediate diameter 64*a* facing the substantially radial large diameter surface 64*c* close to the surface 62. A shoulder 64*b* extends between the substantially radial intermediate diameter surface 64*a* and a substantially radial large diameter surface 64*c*. The substantially radial large diameter surface 64*c* extends from the tapered surface 20 at least to the hole 17*a* to allow the male device 32 to pass through. Towards the interior, the body 64 comprises a shoulder 64*d* and a substantially radial small diameter surface 64*e*. The shoulder 64*d* is in contact with the surface 62. The substantially radial small diameter surface 64*e* faces the substantially radial small diameter surface 61 of the interposed part 60, preferably at a distance. The substantially radial large diameter surface 64*c* is axially disposed between the substantially radial small diameter surface 64*e* and the intermediate diameter substantially radial surface 64*a*. The shoulder 64*b* is positioned radially flush with the first hole 17*a*. The sealing surface 82 is provided between the substantially radial large diameter surface 63 and the end surface 14. The sealing surface 82 has the same orientation as the tapered surface 20. The sealing surface 82 has a mean inclination that is greater than or equal to the inclination of the tapered surface 20. The sealing surface 82 is generally tapered and also may have a bulged shape in the form of (a) circular or elliptical arc or arcs. The maximum diameter of the sealing surface 82 is greater than the minimum diameter of the sealing surface 14.

The surface 62 serves to centre the interposed part 60 on the body 64. The substantially radial small diameter 61 and large diameter 63 surfaces are separated from the body 64. Axial forces between the body 64 and the interposed part 60 may be transmitted via the male connecting device 32. More precisely, the portion of the male device 32 corresponding to the substantially radial portions 34*b* and 35*b* is in an interference fit between the substantially radial large diameter surface 63 and the substantially radial large diameter surface 64*c*. Said substantially radial portion of the male device 32 is annular. The conductors 34 and 35 may have the shape illustrated in FIG. 9. A seal is obtained. The interposed part 60 has a length on the side of the bore 11 which is greater than its length on the side of the sealing surface 82. In a variation, the interposed part 60 may comprise an upper limb extending beyond the tapered surface 20 which is generally C-shaped, a retaining groove for the sealing ring 50 possibly being provided on a large diameter surface of said upper limb. The first hole 17*a* is provided in the body 64, for example from an end surface, facing the substantially radial large diameter surface 63.

The sealing ring 50 is in contact with the sealing surface 82 of the interposed part 60, providing a seal between the interposed part 60 and the second end 21. A seal by contact between the interposed part 60 and the first end 8 is obtained by contact between the substantially axial or slightly tapered surface 62 and the corresponding surface of the body 64. Any axial forces are transmitted from the body 64 to the interposed part 60 via the substantially radial surfaces 61 and 63, and from the interposed part 60 to the second end 21 via the end surface 14. The interposed part 60 protects the conductors.

The second end 21 comprises a body 75 and a removable tip in the form of an interposed part 70. The interposed part 70 is annular. The shoulder 25 is provided on the interposed part 70. A portion of the tapered surface 26 faces the interposed part 70. A portion of the bore 22 is provided on the interposed part 70. The interposed part 70 has a Z shaped axial section. Moving from the bore 22 to the tapered surface 26, the interposed part 70 comprises a substantially radial small diameter surface 71 then a substantially axial or slightly tapered surface 72, then a substantially radial large diameter surface 73, then a tapered surface 74. The shapes of the corresponding surfaces of the body 75 are analogous to the surfaces 64*a* to 64*e*.

The surface 74 faces the tapered surface 26. The tapered surface 74 is in contact with the female device 33 or at a small distance, especially a link portion of the conductors. The surface 72 is in contact with the corresponding surface of the body 75 of the second end 21. The surfaces 71 and 73 are at a distance from the corresponding surfaces of the body 75. The substantially radial large diameter surface 73 is in contact with the female connecting device 33. The surface 72 centres the interposed part 70 on the body 75. The substantially radial small diameter 71 and large diameter 73 surfaces are separated from the body 75. Axial forces between the body 75 and the interposed part 70 can be transmitted via the female connecting device 33. More precisely, the portion of the female device 33 corresponding to the substantially radial portions 43*b* and 44*b* is in an interference fit between the substantially radial large diameter surface 73 and the corresponding surface of the body 75. Facing the tapered surface 74, the conductors 43 and 44 may or may not be annular. Said substantially radial portion of the female device 33 is annular. A seal is obtained.

The interposed part 70 has an axial length on the bore side 22 which is less than its length on the tapered surface 26 side. Between the bore 22 and the tapered surface 74, axially in the vicinity of the end surface 14, the interposed part 70 comprises the shoulder 25, a tapered surface 76 and a substantially radial surface 77. The tapered surface 76 forms a sealing surface and cooperates with the sealing ring 50. The sealing ring 50 is disposed between the sealing surface 82 and the sealing surface 76. The interposed part 70 comprises a tapered limb between the tapered surfaces 74 and 76, terminating in the substantially radial surface 77. The groove 46 and the first hole 27*a* are provided in the body 75, for example from a shoulder, facing the substantially radial large diameter surface 73. The interposed part 70 protects the conductors. The interposed parts 60 and 70, which are reasonably cheap, can readily be replaced.

The tapered surface 76 comprises a sealing surface 53 in contact with a sealing ring 50 providing a seal between the interposed part 70 and the first end 8. A seal by contact between the interposed part 70 and the first end 8 is obtained by contact between the substantially axial or slightly tapered surface 72 and the corresponding surface of the body 74. Any axial forces are transmitted from the body 74 to the interposed part 70 via the substantially radial surfaces 71 and 73, and from the interposed part 70 to the first end 8 via the end surface 14.

The interposed parts 60 and 70 may act as wear parts, being replaced in the case of deformation at a very low cost compared with the cost of a complete pipe. A junction may comprise one or more interposed parts 60 and 70.

The protected space 54 is essentially defined by the substantially radial surface 77 in the direction of the sealing ring 50. A block 80 is installed in the protected zone 54. The block 80 is annular in shape. The block 80 is tapered. The block 80 is defined by two substantially radial surfaces. The block 80 is defined by two substantially tapered surfaces respectively facing the tapered surface 20 of the first end 8 and facing the tapered surface 26 of the second end 21, optionally in contact with said surfaces. The block 80 is in contact with the conductors 34 and 35 of the first end 8 and in contact with the conductors 43 and 44 of the second end 21. The block 80 comprises a body 81 formed from an electrically insulating material, for example based on polyethylene. The block 80 may be hollow to leave space for the contact portions 34*d* and 35*d*, as illustrated above. The body 81 may be produced from several complementary portions with a generally annular shape. Said portions may be assembled by push fitting or snap fitting, for example using an axial movement. The body 81 has a trapezoidal section in axial section. The block 80 may comprise a cavity for each contact portion 34*d* and 35*d*. The block 80 may keep the electrical contact portions 34*d*, 35*d* apart, reducing the risk of a short circuit.

In this case, the block 80 comprises one electrical conductor 84, 85 per conductor 34, 35. Electrical insulation is obtained by physical separation between the electrical conductors 84 and 85. Each electrical conductor 84, 85 has a generally toroidal shape, optionally with a groove 86 in axial section to increase flexibility. A cut in the annular direction may be provided, forming an open ring. Each electrical conductor 84, 85 may be produced from stainless steel at least partially coated with silver. Each electrical conductor 84, 85 projects beyond the body 81 inwardly and outwardly. The contact portions 34*d* and 35*d* of the conductors 34 and 35 may be flat, for example in the extension of a tapered zone of the link portions 34*c* and 35*c*, see FIG. 3. The contact portions of the conductors 43 and 44 may be flat, for example in the extension of a tapered zone of the link portions 43*c* and 44*c*, see FIG. 3.

Alternatively, the sealing ring 50 is annular in shape, with a substantially trapezoidal section. The sealing ring 50 is defined by two substantially radial surfaces and by two substantially tapered surfaces. The sealing surfaces 52 and 53 are respectively formed by the substantially radial large diameter surface 73 of the interposed part 70 and the surface of the insulated radial portion of the female device 33. Sealing surfaces are respectively formed by the large diameter radial surface 63 of the interposed part 60 and a surface 92 of the insulated annular portion of the male device 32 between the radial surfaces 64*c* and 63. The surface 92 here is substantially radial.

In the embodiment of FIG. 13, a seal may be produced by contact between the first end 8 and the second end 21. The contact may be formed between an interposed part 60 or 70 and the respective tapered surface 26 or 20. In this case, the contact is produced between the interposed part 60 and the interposed part 70. The sealing surface 82 of the interposed part 60 may have mean inclination which is greater than in the preceding embodiment, for example of the order of 3° to 20°. The tapered surface 76 of the interposed part 70 comprises a large diameter portion close to the substantially radial surface 77 and a small diameter portion close to the shoulder 25. The small diameter portion forms the sealing surface 83. The sealing surface 83 may have an inclination close to the inclination of the sealing surface 82. At least one of the sealing surfaces 82 and 83 may be bulged. FIG. 13 shows the junction when made up, with the sealing surfaces 82 and 83 in contact. The terminal surfaces 14 and 25 may be separated by a few millimeters or tens of millimeters. In contrast to FIG. 12, the substantially radial large diameter surface 73 is at an axial distance from the radial portion of the female connecting device 33, the radial portion corresponding to the radial portions 43*b* and 44*b* of the conductors 43 and 44. The tapered surface 74 of the interposed part 70 is in contact with the tapered portion of the female connecting device 33. Said tapered portion is annular. In the tapered portion of the female connecting device 33 in contact with the tapered surface 74, the conductors 43 and 44 are annular. The sealing surfaces 52 and 53 are respectively formed by the tapered surface 74 of the interposed part 70 and the surface of the insulated portion of the female device 33 between said tapered surfaces 26 and 74. Sealing surfaces are respectively formed by the large diameter radial surface 63 of the interposed part 60 and the surface 92 of the insulated portion of the male device 32 between the radial surfaces 64*c* and 63.

Thus, the protected zone 54 is provided by the sealing surfaces between the interposed parts 60 and 70, the sealing surfaces between the interposed part 60 and the body 64 associated with the male connecting device 32, and the sealing surfaces between the interposed part 70 and the body 75 associated with the female connecting device 33. The sealing surfaces between the interposed part 70 and the body 75 associated with the female connecting device 33 may be radial, see FIG. 12, or tapered, see FIG. 13. The conductors may comprise an annular portion corresponding to the sealing surfaces.

As can be seen in FIGS. 12 and 13, the compressive force F exerted between the sealing surfaces 82 and 83 principally acts along a radial component which is separate from the axial compressive force by means of which the pipes are connected together.

The invention claimed is:

1. A tubular component of a drill stem, comprising a first end comprising a first threading, a second end comprising a second threading, and a substantially tubular central zone along a longitudinal axis, the component further comprising an electrical connecting device, mounted on at least one of the ends, and a cable for the transmission of signals between the first end and the second end, connected to the connecting device, the connecting device comprising:

at least one conductor provided with an electrically insulated link portion connected to the transmission cable and an electrical contact portion in an extension of the insulated link portion; and a dielectric means to isolate the insulated link portion, wherein the insulated link portion together with the dielectric means form an annular sealing surface to define, with a sealing ring, an annular protected zone, such that said electrical contact portion is disposed in the annular protected zone, and the annular sealing surface is compressed by an annular sealing surface of a complementary tubular component when the tubular component is connected with the complementary tubular component, the sealing ring being radially disposed between the annular sealing surfaces of the tubular component and the complementary tubular component.

2. A component according to claim 1, in which the annular sealing surface of a tubular component is disposed in a manner which is concentric with the annular sealing surface of a complementary tubular component with which the tubular component is connected.

3. A component according to claim 1, in which said conductor is formed as one piece.

4. A component according to claim 1, in which the dielectric means is formed as one piece.

5. A component according to claim 1, in which said insulated link portion is provided with a portion which is substantially radial relative to the longitudinal axis.

6. A component according to claim 1, in which at least one conductor comprises a bare zone within said electrical contact portion, said bare zone and a bare zone of a conductor of a complementary electrical connecting device being in mutual contact in the annular protected zone when connected.

7. A component according to claim 1, in which said contact is elastic.

8. A component according to claim 1, in which at least one conductor comprises a pointed portion within said electrical contact portion, said pointed portion being configured to reach an electrical contact portion of a conductor of a complementary electrical connecting device passing through the dielectric means.

9. A component according to claim 5, in which each conductor is surrounded by a dielectric means in the insulated link portion and in the substantially radial insulated portion.

10. A component according to claim 1, in which the electrical connecting device comprises two conductors, each provided with a bare zone, said bare zones being axially offset so that they are respectively in contact with the bare zones of a complementary device when connected, a common insulator being disposed between the insulated link portions of the conductors.

11. A component according to claim 1, in which a bare zone of a conductor comprises an elastic boss provided to cooperate with an annular surface of a corresponding bare zone of another complementary conductor when connected.

12. A component according to claim 1, in which the insulated link portion is annular over at least a portion of its length.

13. A component according to claim 1, in which a sealing ring is disposed in contact with the insulated link portion.

14. A component according to claim 13, in which part of the sealing ring is disposed in a housing provided by the insulated link portion.

15. A component according to claim 1, in which the electrical contact portion is annular.

16. A component according to claim 1, in which the electrical contact portion comprises a plurality of regularly distributed angular sectors.

17. A component according to claim 1, in which the electrical contact portion comprises an angular sector.

18. A component according to claim 1, comprising at least two conductors and a block disposed in the annular protected zone to keep the electrical contact portions of the conductors apart.

19. A component according to claim 1, in which at least one of the first end and the second end is male, the annular sealing surface being disposed on the outer surface of the insulated link portion.

20. A component according to claim 1, in which at least one of the first end and the second end is female, the annular sealing surface being disposed on the inner surface of the insulated link portion.

21. A junction comprising two components in accordance with claim 1, and an interposed part provided with a sealing ring, the interposed part being disposed between a male connecting device of one of the components and a female connecting device of the other component.

22. A tubular component of a drill stem, comprising a first end comprising a first threading, a second end comprising a second threading, and a substantially tubular central zone along a longitudinal axis, the component further comprising an electrical connecting device, mounted on at least one of the ends, and a cable for the transmission of signals between the first end and the second end, connected to the connecting device, the connecting device comprising:

at least one conductor provided with an electrically insulated link portion connected to the transmission cable and an electrical contact portion in an extension of the insulated link portion; and a dielectric means to isolate the insulated link portion, wherein the component comprises an interposed part with an L-shaped or a Z-shaped axial section fixed to said end comprising the electrical connecting device, such that a radial portion of said interposed part defines at least one annular surface about the longitudinal axis to form an annular sealing surface in order to define, at least in part, an annular protected zone, such that said electrical contact portion is disposed in the annular protected zone, and the annular sealing surface is compressed by an annular sealing surface of a complementary tubular component when the tubular component is connected with the complementary tubular component.

* * * * *